US011842876B2

(12) United States Patent
Bianchin et al.

(10) Patent No.: US 11,842,876 B2
(45) **Date of Patent: *Dec. 12, 2023**

(54) SINGLE BOLT FUSE ASSEMBLY WITH AN ELECTRICALLY ISOLATED BOLT

(71) Applicant: Littelfuse, Inc., Chicago, IL (US)

(72) Inventors: Tiziano Bianchin, Verona (IT); Massimiliano Tinto, Verona (IT); Andrew J. Jozwiak, Chicago, IL (US); Geoffrey Schwartz, Stoughton, MA (US)

(73) Assignee: Littelfuse, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/894,239

(22) Filed: Aug. 24, 2022

(65) Prior Publication Data

US 2022/0406551 A1 Dec. 22, 2022

Related U.S. Application Data

(63) Continuation of application No. 17/506,063, filed on Oct. 20, 2021, now Pat. No. 11,469,070, which is a continuation of application No. 17/173,715, filed on Feb. 11, 2021, now Pat. No. 11,195,683.

(51) Int. Cl.

| | |
|---|---|
| ***H01H 85/20*** | (2006.01) |
| ***H01H 85/22*** | (2006.01) |
| ***H01R 13/68*** | (2011.01) |

(52) U.S. Cl.

CPC ..... *H01H 85/2045* (2013.01); *H01H 85/205* (2013.01); *H01H 85/2005* (2013.01); *H01H 85/22* (2013.01); *H01R 13/68* (2013.01); *H01H 2223/024* (2013.01)

(58) Field of Classification Search

CPC ..... H01H 85/2005; H01H 85/2045; H01H 85/205; H01H 85/22; H01H 2085/025; H01H 2223/024; H01R 13/68

See application file for complete search history.

(56) References Cited

U.S. PATENT DOCUMENTS

| | | | | |
|---|---|---|---|---|
| 4,358,633 | A * | 11/1982 | Reynolds, Jr. | H02G 5/005 249/97 |
| 5,805,047 | A * | 9/1998 | De Villeroche | H01R 11/283 337/5 |
| 6,855,008 | B1 | 2/2005 | Freitag et al. | |
| 7,172,462 | B1 | 2/2007 | Gronowicz, Jr. | |
| 2001/0051450 | A1* | 12/2001 | Ross | H05K 1/0263 439/78 |

(Continued)

*Primary Examiner* — Jacob R Crum

(74) *Attorney, Agent, or Firm* — KDW FIRM PLLC

(57) ABSTRACT

A single bolt fuse assembly and method to connect a single bolt fuse to a circuit or device are disclosed. The single bolt fuse assembly enables the single bolt fuse to be used on any electrical device having a hole suitable for receiving a threaded shaft and connectable to a circuit or device that electrically connects to a female battery or power cable. The apparatus includes a separate high-conductive metal terminal that mates with the stud that mechanically attaches the fuse between the electrical devices. The stud is insulated to avoid becoming part of the electrical circuit and to ensure proper operation of the fuse. By mechanically attaching the stud to the metal terminal, the stud is unlikely to get separated from the fuse.

13 Claims, 10 Drawing Sheets

(56) References Cited

U.S. PATENT DOCUMENTS

| | | | | |
|---|---|---|---|---|
| 2002/0076984 | A1 | 6/2002 | Kieninger | |
| 2003/0071711 | A1 | 4/2003 | Haupt et al. | |
| 2004/0018417 | A1 | 1/2004 | Stack | |
| 2006/0223384 | A1* | 10/2006 | Schuh | H01R 11/282 439/759 |
| 2009/0066469 | A1 | 3/2009 | Rahman et al. | |
| 2011/0148564 | A1 | 6/2011 | Staylor | |
| 2012/0064771 | A1 | 3/2012 | Urrea et al. | |
| 2013/0202380 | A1 | 8/2013 | Kawamura | |
| 2014/0090872 | A1* | 4/2014 | Onoda | H02G 5/04 174/133 B |
| 2014/0097932 | A1 | 4/2014 | Fussl | |
| 2014/0099836 | A1* | 4/2014 | Joseph | H01R 25/162 439/723 |
| 2016/0071678 | A1 | 3/2016 | Schwartz et al. | |
| 2017/0327064 | A1 | 11/2017 | Leverett et al. | |
| 2017/0345601 | A1* | 11/2017 | Kitano | H01M 50/581 |
| 2018/0301310 | A1* | 10/2018 | Allcorn | H01H 85/205 |
| 2020/0203110 | A1 | 6/2020 | Mantoan et al. | |

* cited by examiner

SINGLE BOLT FUSE ASSEMBLY WITH AN ELECTRICALLY ISOLATED BOLT

CROSS REFERENCE TO RELATED APPLICATION

This application is a continuation of, and claims the benefit of priority to, U.S. patent application Ser. No. 17/506,063, filed Oct. 20, 2021, and to U.S. Pat. No. 11,195,683, issued on Dec. 7, 2021, entitled "SINGLE BOLT FUSE ASSEMBLY WITH AN ELECTRICALLY ISOLATED BOLT," which applications are incorporated herein by reference in their entirety.

FIELD OF THE DISCLOSURE

Embodiments of the present disclosure relate to single bolt fuses and, more particularly, to a novel way to attach the single bolt fuse to a female battery or power cable.

BACKGROUND

Fuses are current-sensitive devices designed to serve as the intentional weak link in an electronic circuit. Fuses provide protection of discrete components or of complete circuits by reliably melting under current overload conditions. Fuses come in a variety of packages and ratings to suit to their intended application.

Single bolt fuses, also known as battery terminal fuses, are a particular type of fuse package in which the fuse is attached to a device or circuitry by a threaded connection, such as a bolt or stud. The fuse includes a hole through which a single bolt may be inserted to mechanically connect the fuse to the device or circuit. The bolts are specially adapted, such as by being insulated or otherwise materially treated, so that they do not disrupt or become part of a current path through the fuses, ensuring that the single bolt fuses operate as designed.

To use the single bolt fuses, the specially treated bolt is separated from the fuse, the fuse is attached to the circuit or device to be protected, the bolt is inserted through the hole in the fuse. Sometimes, the bolt has an integrated nut, or bolt may be secured by a separate nut. Because of the assembly needed with single bolt fuses, the bolt (and nut, if present) may become separated from the fuse and lost. Customers may be tempted to replace the lost bolt with a standard bolt that is not specially adapted for the single bolt fuse. Unfortunately, this results in the single bolt fuse not functioning as designed. Further, the single bolt fuse is designed to be connected between a power terminal and either a battery terminal or a bus bar, which somewhat limits the applications in which the fuse may be used.

It is with respect to these and other considerations that the present improvements may be useful.

SUMMARY

This Summary is provided to introduce a selection of concepts in a simplified form that are further described below in the Detailed Description. This Summary is not intended to identify key or essential features of the claimed subject matter, nor is it intended as an aid in determining the scope of the claimed subject matter.

An exemplary embodiment of a fuse assembly in accordance with the present disclosure may include an insulated steel bolt and a metal terminal. The insulated steel bolt includes a shaft that is part threaded and part insulated. Connected to the shaft, the insulated steel bolt also includes a base, which is a rectangular cube having a first dimension. The shaft is positioned vertically atop one side of the base. The metal terminal features a bolt base receptacle, also shaped like a rectangular cube, and having a hollow interior with a second dimension that is greater than that of the base. The base of the steel bolt fits into the hollow interior of the bolt base receptacle. The metal terminal also has a threaded shaft on one side of the bolt base receptacle. The shaft of the insulated steel bolt is to be fed through a cylindrical opening of a fuse.

Another exemplary embodiment of a fuse assembly in accordance with the present disclosure may include an electrically conductive landing pad which has a threaded shaft and a hollow receptacle. The threaded shaft fits into a receiving aperture of an electrical device. The fuse assembly also features a stud that has an insulated base portion, an insulated washer, and a shaft. The shaft has a threaded portion, an unthreaded portion, and an insulated portion. The base portion of the stud fits into the hollow receptacle of the landing pad and the shaft portion fits through a cylindrical opening of a single bolt fuse. In the fuse assembly, current passes from the electrical device, through the single bolt fuse, and to a second electrical device without passing through the stud.

DETAILED DESCRIPTION

A single bolt fuse assembly and method to connect a single bolt fuse to a circuit or device are disclosed. The single bolt fuse assembly enables the single bolt fuse to be used on any electrical device having a hole suitable for receiving a threaded shaft and connectable to a circuit or device that electrically connects to a female battery or power cable. The apparatus includes a separate high-conductive metal terminal that mates with the stud that mechanically attaches the fuse between the electrical devices. The stud is insulated, thus isolating the bolt from becoming part of the electrical circuit and ensuring proper operation of the fuse. By mechanically attaching the stud to the metal terminal, the stud is unlikely to get separated from the fuse. The metal terminal and stud may be part of a kit available to customers who purchase the single bolt fuse.

Figure 1:
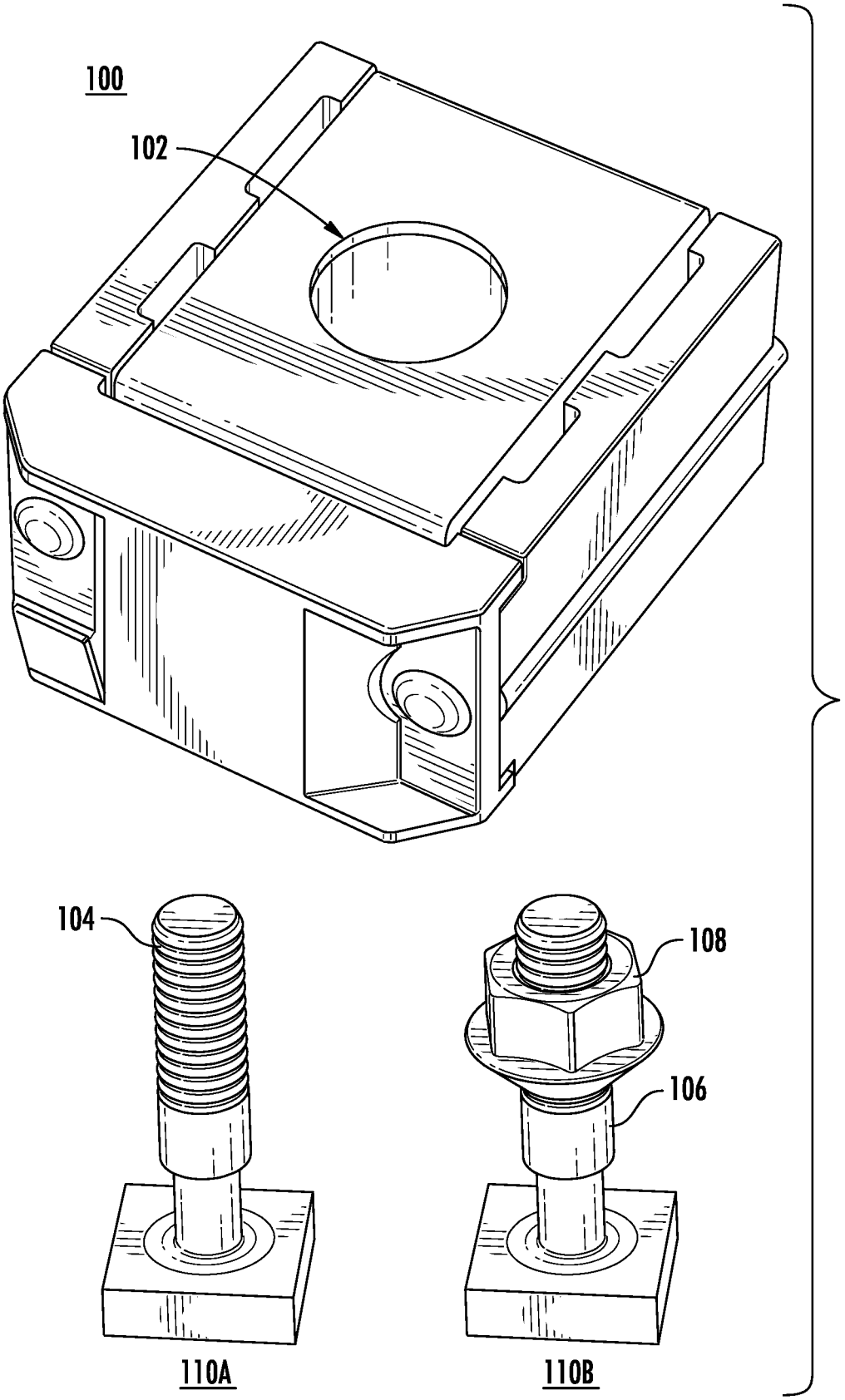
FIG. 1 is a diagram illustrating a single bolt fuse, according to the prior art.

FIG. 1 is a representative drawing of a 250A single bolt fuse 100 for providing circuit protection, according to the prior art. The single bolt fuse 100 features a receptacle 102, such as a cylindrical hole, for receiving a like-sized threaded bolt, known as a stud. The fuse simply slips over the bolt or stud. Two studs 110A and 110B (collectively, "studs 110") are also shown, the stud 110A featuring a threaded shaft 104 and the stud 110B featuring a threaded shaft 106 and further including a flange nut 108. The studs 110 are designed to be electrically isolated when inserted through the fuse hole 102 of the single bolt fuse 100. Accordingly, the studs 110 may be insulated or otherwise materially treated so that the studs do not become part of the electrical path through which current flows when the single bolt fuse 100 is connected to a circuit or device to be protected.

Figure 2A:
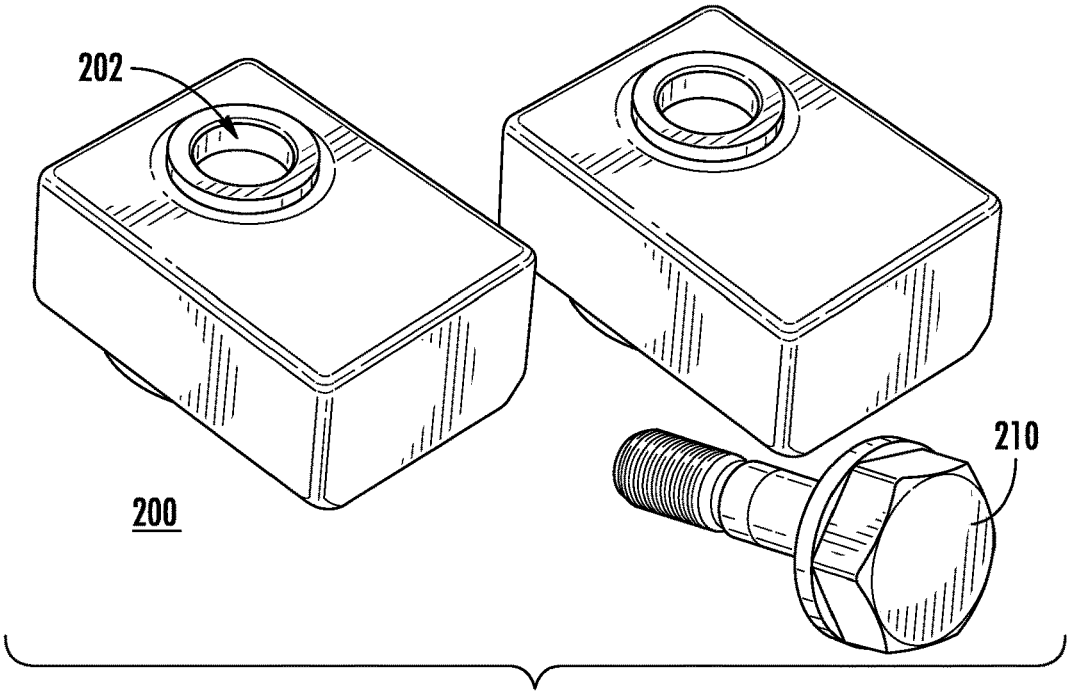
FIG. 2A (PRIOR ART)
FIGS. 2A and 2B are diagram illustrating a single bolt fuse and assembly, according to the prior art.
Figure 2B:
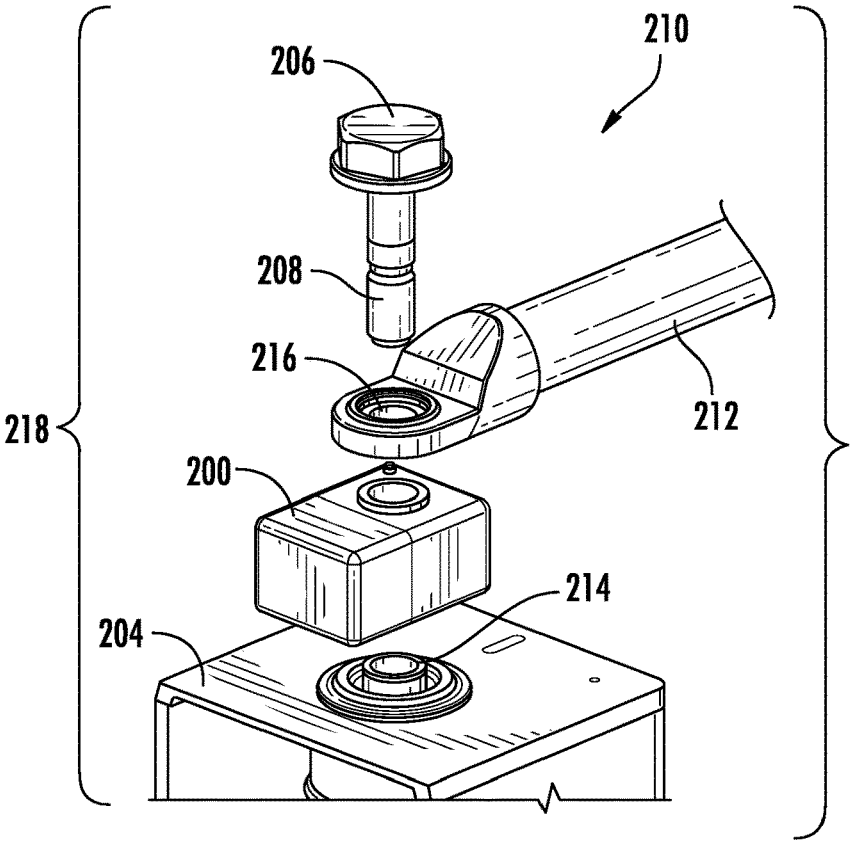
FIG. 2B (PRIOR ART)

FIGS. 2A and 2B illustrate another single bolt fuse 200, according to the prior art. Two fuses 200 are depicted in FIG. 2A, each including a hole 202 for receiving a threaded stud 210. The stud 210 includes an insulated, threaded portion 208 and an integrated nut 206. As illustrated in the single bolt fuse assembly 218 (FIG. 2B), the fuse 200 is to be connected to a battery 204, which has a receiving aperture 214 sized to support the threaded portion 208 of the stud 210. A sealed power cable 212 to connect the battery 204 to other circuitry/device (not shown) also includes a receiving aperture 216. The single bolt fuse 200 is placed between the battery 204 and the sealed power cable 212, with the insulated bolt 210 threading through respective holes 214 and 216, sealing the components together.

Figure 3A:
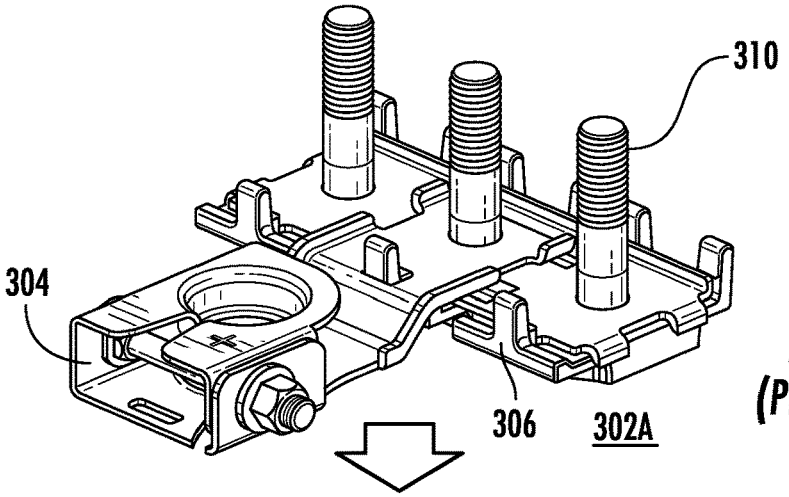
FIG. 3A (PRIOR ART)
FIGS. 3A-3C are diagrams illustrating a single bolt fuse assembly, according to the prior art.
Figure 3B:
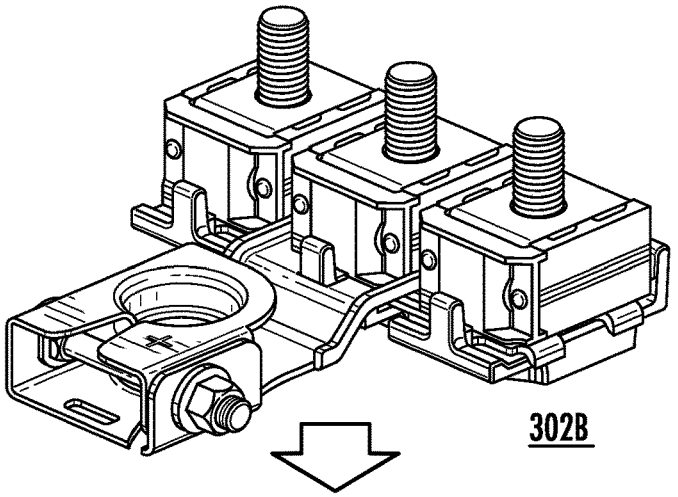
FIG. 3B (PRIOR ART)
Figure 3C:
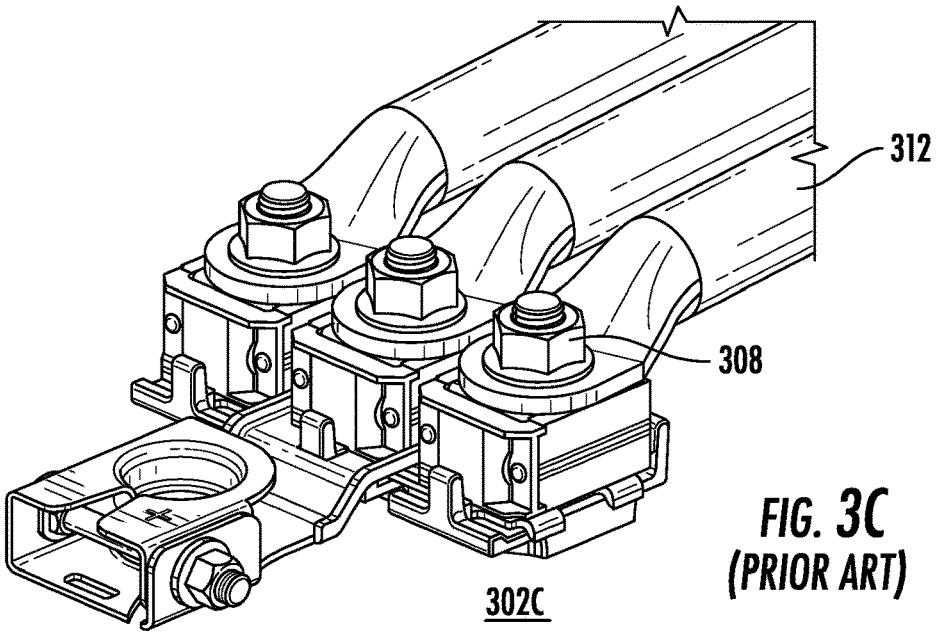
FIG. 3C (PRIOR ART)

FIGS. 3A-3C illustrate an assembly 302 featuring single bolt fuses 300, according to the prior art, with the assembly shown in three parts (302A, 302B, and 302C). In the assembly 302, three threaded studs 310 are inserted through a busbar 306, from the bottom. A battery terminal 304 is then placed over the center stud. Three single bolt fuses 300 are then placed on the studs 310. Output power cables 312 are then placed on top of the fuses 300, also over the studs 310, as the cables include ring terminals for this purpose. The components are then secured with nuts 308.

Thus, the fuses 100, 200, and 300 are designed to be used with their respective studs 110, 210, and 310. The studs are insulated to isolate current so that the current passes through the fuse (and not the stud), enabling the fuse to protect the circuit (e.g., the circuit or device connected to the output cable 212 (FIG. 2B) or output cable 312 (FIG. 3C)) as intended.

One problem with single bolt fuses, including the above illustrated single bolt fuses, is that the studs that are specially made to be used with the fuses may become separated from the fuses. Customers may then be tempted to replace the missing studs with standard bolts that are uninsulated. When this occurs, the fuse will not operate as designed.

For example, in the assembly of FIG. 2B, current from the battery 204 passes through the fuse 200, then through the sealed power cable 212 to other circuitry (not shown); in the other direction, current passes through the sealed power cable 212, through the fuse 200, and to the battery 204. If an overcurrent condition from the battery 204 occurs, the fuse 200 includes a breakaway portion therein that will break, protecting any circuitry connected to the sealed cable 212. The assembly 218 thus operates as designed.

If, in the alternative, the insulated stud 210 is replaced with an uninsulated stud not designed to be used with the fuse 200, current will flow from the battery 204, through the uninsulated stud, and through the sealed cable 212, completely bypassing the fuse 200. The same will happen in the other direction: current will flow from the circuitry to be protected (not shown) through the sealed cable 212, through the uninsulated stud, and to the battery 204, completely bypassing the fuse 200. Put another way, the uninsulated stud will electrically connect the top and the bottom of the fuse, removing the fuse from the circuit. Thus, the use of a stud not designed to be used with the fuse 200 will prevent the fuse from operating as designed to protect the circuitry. Similar problems will exist for the fuses 100 and 300 if they are used with uninsulated studs.

Another problem with single bolt fuses is the limited environment in which they can operate. As currently designed, the fuses are connected, at one end, to the battery or power cable and, at the other end, to either a battery terminal or to a bus bar. In the example of FIG. 2B, the fuse 200 is positioned between the power cable 212 and the battery 204. In the example of FIG. 3C, the fuse 300 is positioned between the power cables 312 and the busbar 306 (which is connected to the battery terminal 304). Thus, the configurations available for using legacy single bolt fuses is somewhat limited.

Figure 4A:
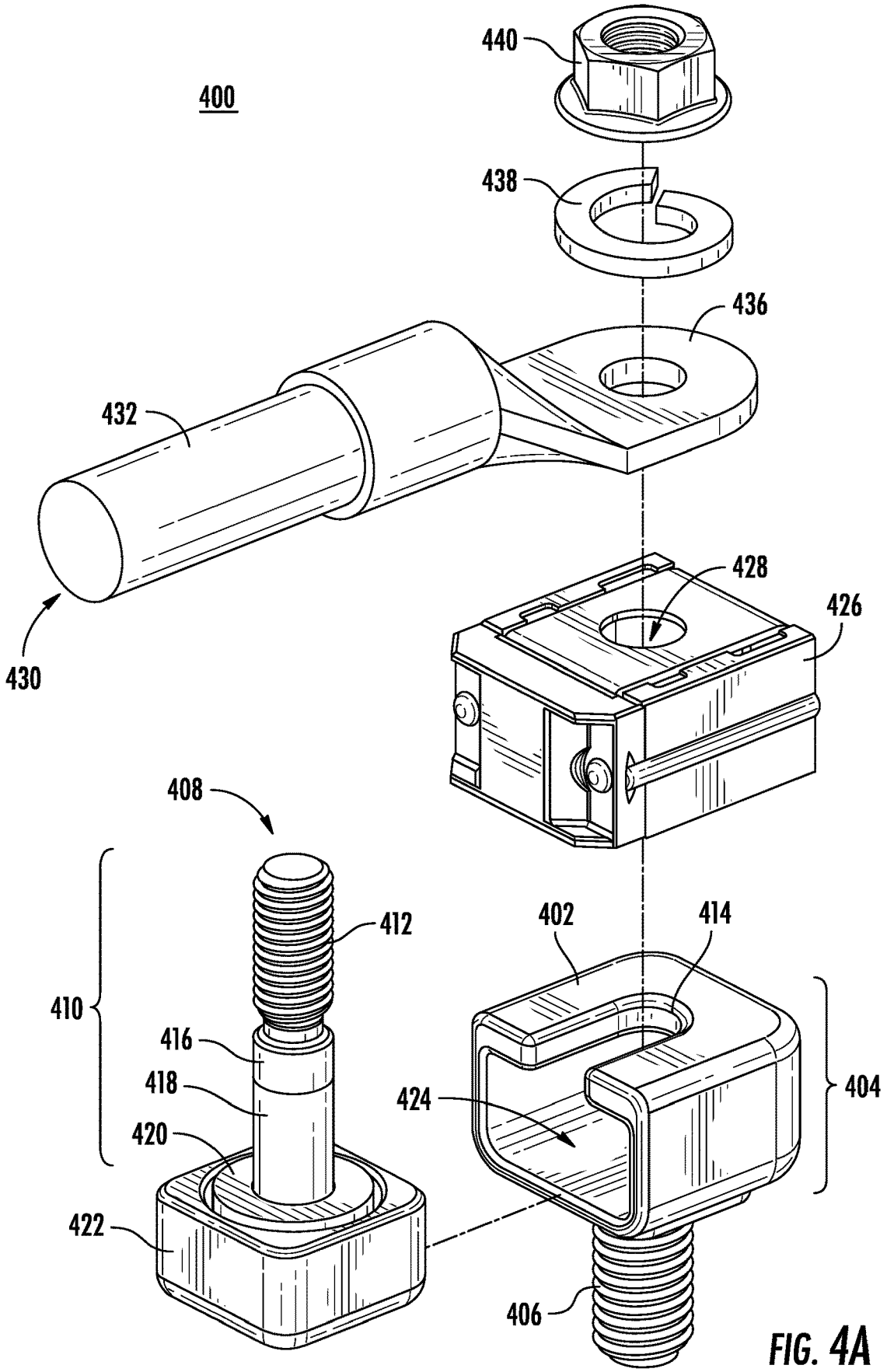
FIGS. 4A-4C are diagrams illustrating a single bolt fuse assembly, in accordance with exemplary embodiments.
Figure 4B:
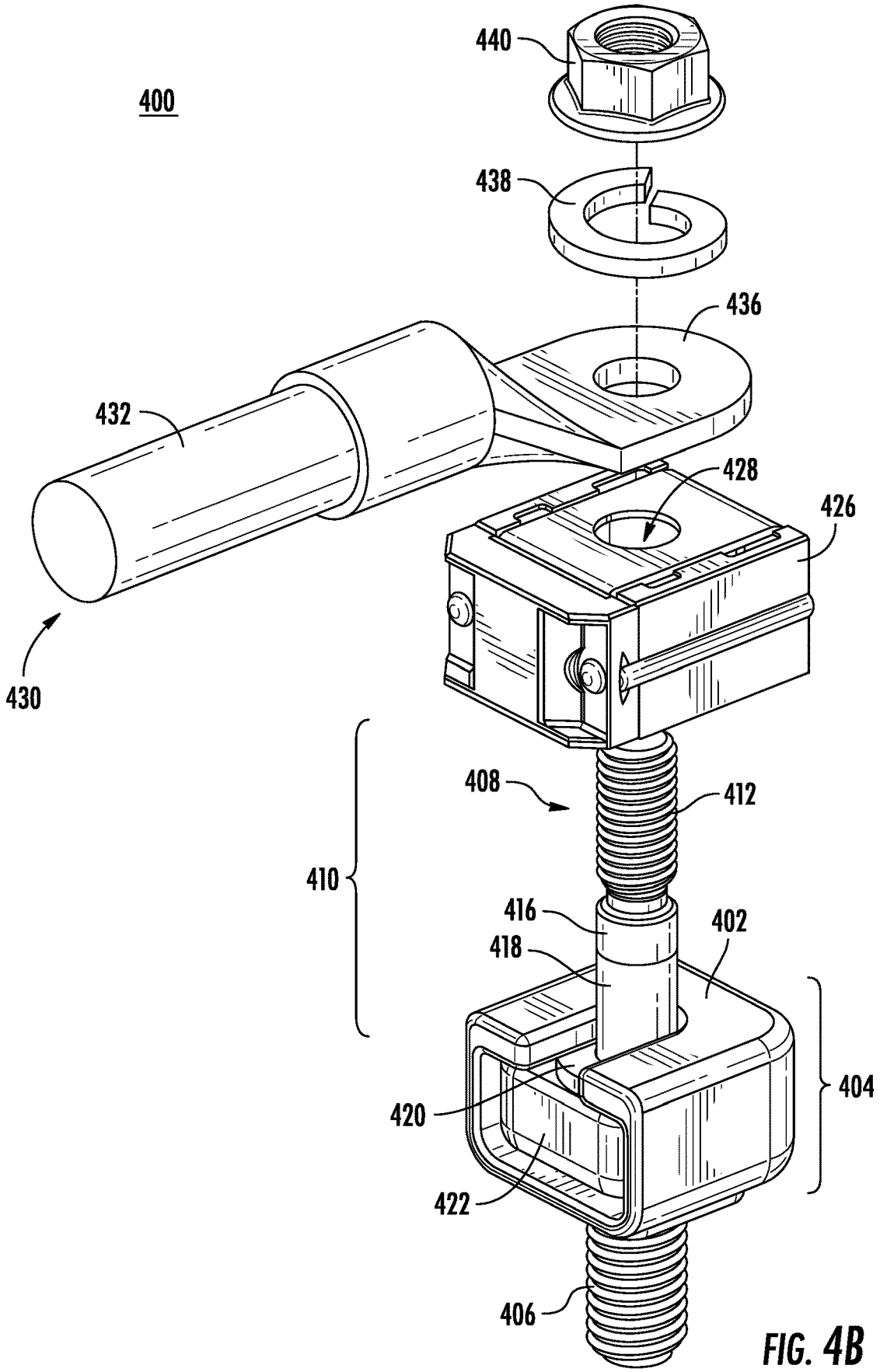
Figure 4C:
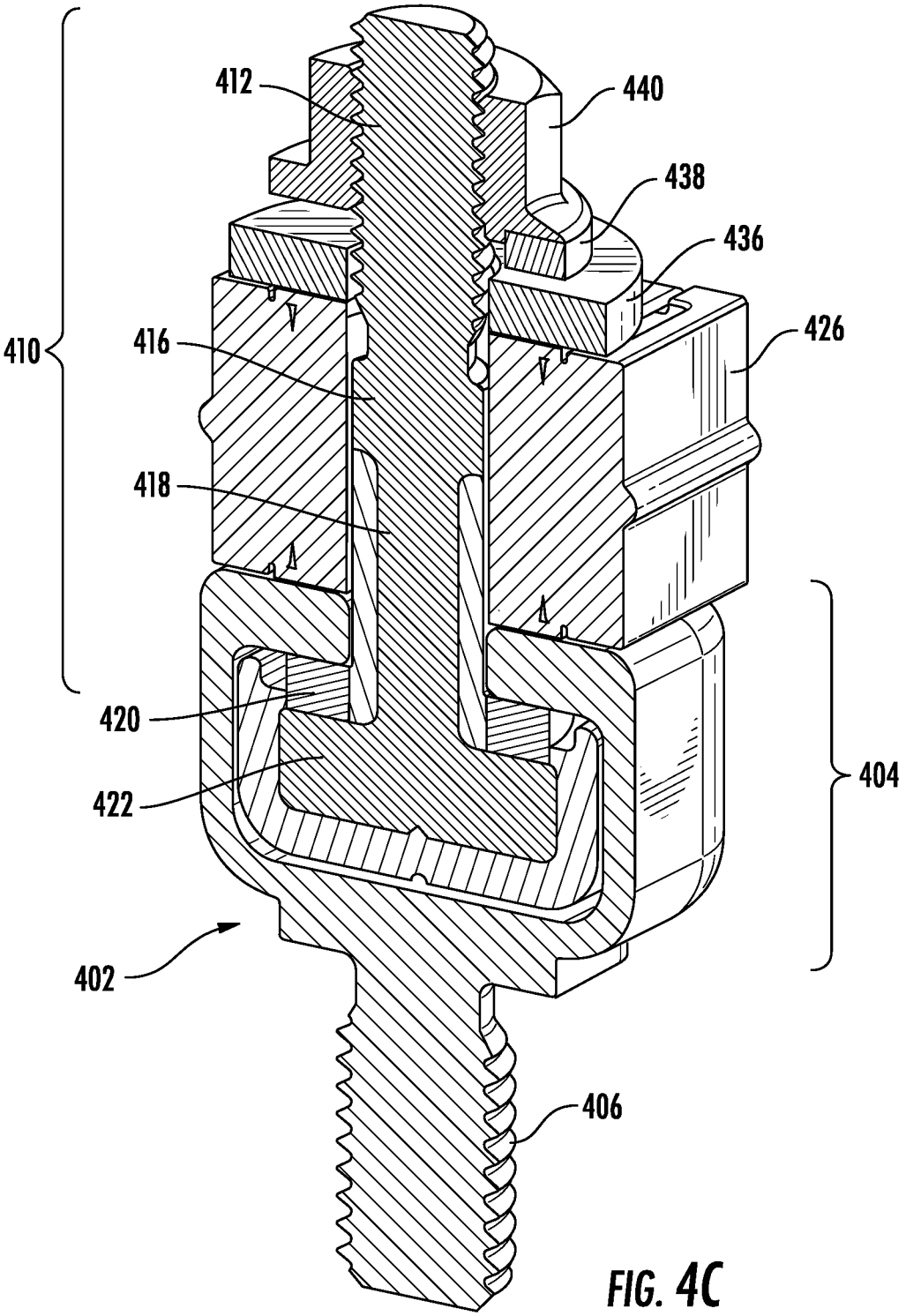

An alternative is provided in the apparatus of FIGS. 4A-4C, a single bolt fuse assembly with an electrically isolated bolt 400, according to exemplary embodiments. FIGS. 4A and 4B are exploded perspective views while FIG. 4C is a perspective cutaway view of the single bolt fuse assembly 400. The single bolt fuse assembly 400 features a metal terminal 402, an insulated steel bolt 408 (also known herein as a stud 408), a single bolt fuse 426, and a female battery or power cable 430, which are joined together as described herein. As will be shown, the single bolt fuse assembly 400 maintains a connection between the insulated steel bolt 408 and the single bolt fuse 426, thus ensuring proper functioning of the fuse as a protector of connected circuits or devices.

The metal terminal 402, also known as the "landing pad" of the fuse assembly 400, includes a bolt base receptacle 404 and a threaded shaft 406. The threaded shaft 406 enables connection of the single bolt fuse assembly 400 with any electrical device having a threaded receiving aperture. The metal terminal 402 further includes an adjacent side opening 424, revealing a hollow interior, as well as an inset portion 414. In exemplary embodiments, the threaded shaft 406 and the bolt base receptacle 404 of the metal terminal 402, including the opening 424 and the inset portion 414, are machined from a unitary metal piece made of electrically conductive material, such as copper or a copper alloy.

The steel bolt or stud 408 of the single bolt fuse assembly 400 features a shaft 410 that has a threaded portion 412, an unthreaded portion 416, an insulated portion 418, an optional integrated washer 420, and a base 422. In addition to the insulated portion 418 of the shaft 408 being insulated, the integrated washer 420 and the base 422 are also insulated so as to isolate them from current transmitted through the assembly. In addition to providing insulation so as to prevent current flow through the stud 408, the integrated washer 420 also helps to withstand pressure after the assembly 400 is secured by the nut 440. In an alternative embodiment, the insulation of the base 422 is sufficient to prevent current flow through the stud and to withstand high mechanical pressures during torque of the nut 440. Thus, the stud 408 may be configured without the integrated washer 420. In an exemplary embodiment, the insulated components of the assembly 400 are insulated using electrically insulating material, such as overmolded plastic, though other insulation materials may also be used.

In the illustrations, the bolt base receptacle 404 is a rectangular cube shape of a first dimension. The hollow interior of the bolt base receptacle 404, which is a second dimension smaller than the first dimension, is disposed on one side adjacent the side with the threaded shaft 406. As illustrated in FIG. 4B, the base 422 of the stud 408, which is a third dimension, fits snugly into the bolt base receptacle 404 of the metal terminal 402. Thus, the second dimension is slightly greater than the third dimension, allowing the base 422 to fit into the hollow interior via the opening 424 of the base receptacle 404. The inset portion 404 of the bolt base receptacle 404 is disposed opposite the threaded shaft 406, and the shaft 410 of the stud 408 fits into the inset portion 404 as the base 422 is laterally presented into the base receptacle 404. Once fully inserted, the threaded shaft 406 of the metal terminal 402 appears to be along the same axis as the shaft 410 of the stud 408, in an exemplary embodiment.

Alternatively, the two shafts 406 and 410 may be in different axes. For example, where the bolt base receptacle 404 is now substantially cubic in shape, a more elongated rectangular cube-shaped receptacle may result in the shaft 406 of the metal terminal 402 being in one axis and the shaft 410 of the stud 408 being in a different axis, with the two axes being parallel to one another. Or the inset portion 414 may be machined into a different side of the bolt base receptacle 404 (a side not opposite the threaded shaft 406). This would result in the shaft 410 of the stud being in an axis orthogonal to the threaded shaft 406. Or the opening 424, which is now on a side adjacent to the threaded shaft 406, may instead be on the side opposite the threaded shaft, where the inset portion 414 is now located, in which case the shaft 410 of the stud would be orthogonal to the shaft 406 of the metal terminal 402. Designers of ordinary skill in the art will recognize a number of ways in which the landing pad 402 may be machined to receive the base 422 and shaft 410 of the stud 408 without departing from the spirit of this disclosure.

Once inserted into the landing pad 402, the insulated steel bolt 408 may be captured or mechanically locked in the bolt base receptacle 404. In an exemplary embodiment, orbital riveting, a mechanical bottleneck, a secondary lock, or other means are employed to mechanically lock the bolt 408 to the metal terminal 402.

The fuse 426 of the single bolt fuse assembly 400 includes a cylindrical opening 428, a shaft receptacle, for receiving the shaft 410 of the stud 408. In an exemplary embodiment, once the insertion of the shaft 410 through the fuse is complete, the single bolt fuse 426 is disposed atop and adjacent to a top surface of the bolt base receptacle 404, as illustrated in the cutaway view of FIG. 4C. Further, both the unthreaded portion 416 and the insulated portion 418 of the shaft 410 are disposed within the shaft receptacle 428 of the single bolt fuse 426. In an exemplary embodiment, the shaft 410 is insulated from a bottom portion of the fuse terminal, ensuring that the bolt will not conduct the fuse element (not shown) within the fuse 426. The insulation may be higher than is shown. In an exemplary embodiment, the threaded portion 412 of the shaft 410 extends to the top of the fuse 426. In an exemplary embodiment, the insulating layer/portion 418 and the insulating washer 420 of the single bolt fuse assembly 400 isolates the center bolt 408 from the fuse 426. The single bolt fuse 426 may also be known as a coaxial fuse, as the two terminals that are connected by the fuse element are actual coaxial. That is, their holes are concentric and placed in different (parallel) planes. This is in contrast to some fuses which have a linear shape with the fuse element in the middle, with a terminal on each side.

Similar to other fuses, the single bolt fuse 426 includes within its housing a fusing element (the intentional weak link that breaks upon the occurrence of an overload event, such as overcurrent, overvoltage, or both), connection means for connecting the fusing element to terminals (ensuring that the fusing element is part of a closed circuit), and fusing powder. This part of the fuse 426 containing the fuse element is known herein as the fuse element housing.

In an exemplary embodiment, the shaft receptacle 428 is isolated from the fusing element housing. The fusing element housing of the single bolt fuse 426 may thus be thought of as an annular housing, shaped like a rectangular donut, with the shaft receptacle 428 being both physically and electrically isolated from the fusing element housing.

Atop the fuse 426, the single bolt fuse assembly 400 includes the female battery or power cable 430, which includes a cable 432 and a high-current electrical (ring) terminal 436. The cable 432 attaches the fuse 426 at one end to a circuit or device to be protected (not shown) while the threaded shaft 406 of the landing pad 402 attaches the fuse at the other end to virtually any electrical component that has a hole through which the landing pad may be threaded, enabling the electrical component to be electrically connected to the fuse 426. The threaded portion 412 of the stud 408 is fed through the ring terminal 436, and the female battery or power cable 430 is attached to the assembly by an optional washer 438 and a nut 440. In the illustrations, the nut 440 is a flange nut, but a regular nut may also be used as long as torque loosening is avoided during use of the assembly 400. In the single bolt fuse assembly 400, the washer and the nut are not part of the current path, and so need not be insulated. This means that, if lost, the optional washer and nut may be replaced without compromising the operation of the fuse 426.

The low-resistant landing pad 402 lets current flow through the fuse 426 and the battery or power cable 430. The steel insulated bolt 408 guarantees a high torque to fix the assembly 400 without being involved in the electrical flow.

Figure 5A:
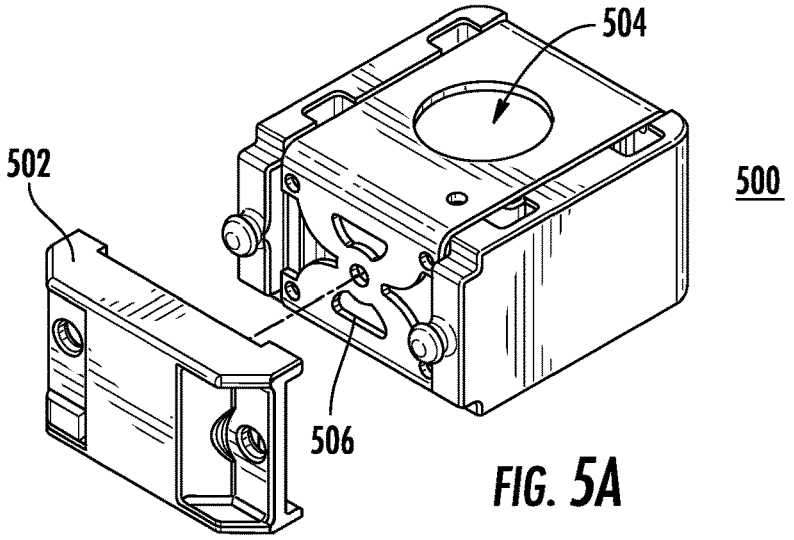
FIGS. 5A-5C are diagrams illustrating a single bolt fuse to be used with the single bolt fuse assembly of FIG. 4, in accordance with exemplary embodiments.
Figure 5B:
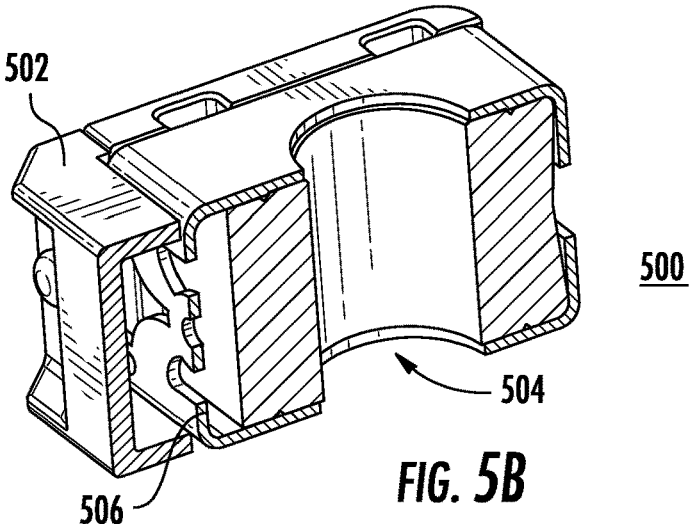
Figure 5C:
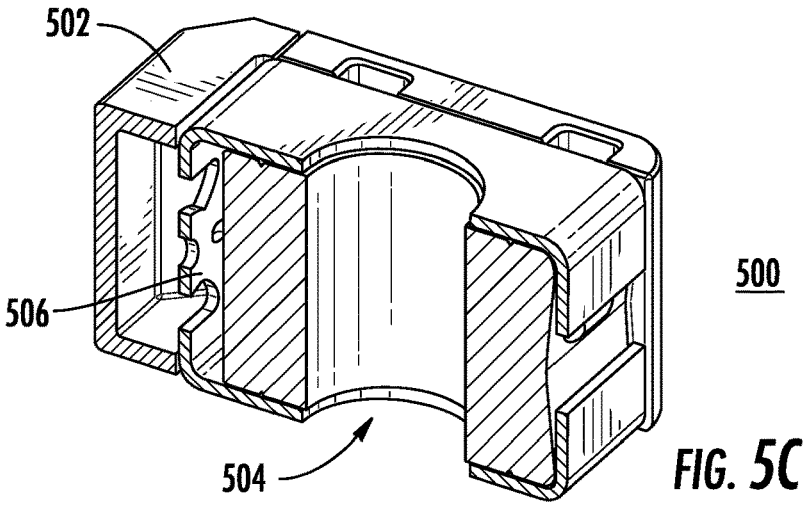

FIGS. 5A-5C are perspective cutaway illustrations of a single bolt fuse 500 suitable for the single bolt fuse assembly 400, according to exemplary embodiments. A cover portion 502, when removed, reveals a fusing element 506 disposed to one side of the fuse 500. A shaft receptacle 504 is for receiving an insulated shaft, such as the shaft 410 described above. The shaft receptacle 504 is both physically and electrically isolated from the fusing element 506.

Figure 6:
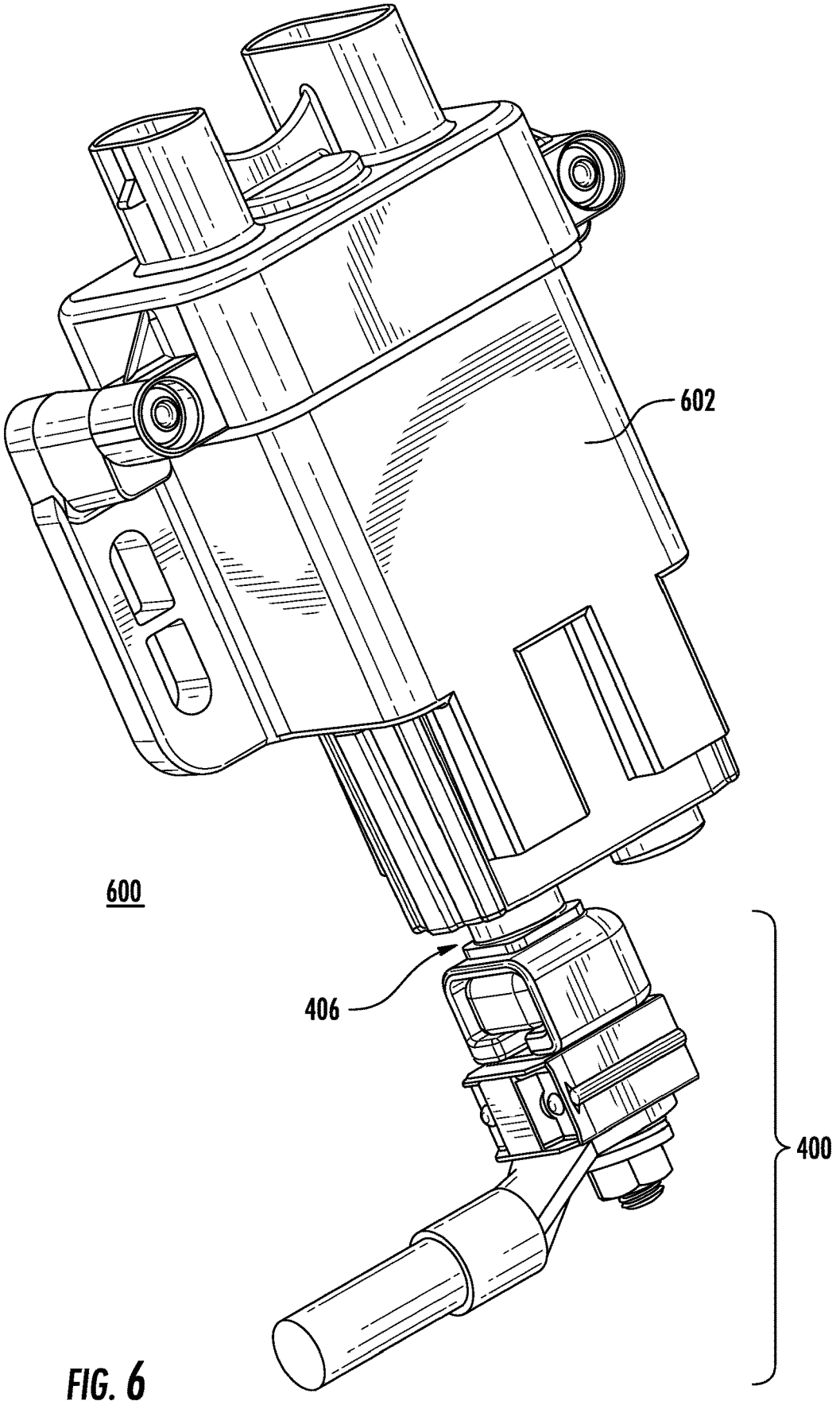
FIG. 6 is a diagram of the single bolt fuse assembly of FIG. 4 connected to a relay, in accordance with exemplary embodiments.

FIG. 6 is a perspective illustration of a configuration 600 featuring the single bolt fuse assembly with an electrically isolated bolt 400 connected to a relay 602, according to exemplary embodiments. The single bolt fuse assembly 400 is connected to the relay 602 by the threaded shaft 406 of the landing pad 402. The relay 602 includes a threaded hole (not shown) for receiving the threaded shaft 406, thus establishing an electrical connection between the relay 602 and the fuse 426. The configuration 600 may further be connected to an electrical circuit or device via the female battery or power cable (such as female battery or power cable 430 in FIGS. 3A and 3B). The configuration 600 is merely illustrative. The single bolt fuse assembly 400 is designed to connect between 1) any electrical device that includes a threaded hole for receiving the threaded shaft 406 of the landing pad 402 and 2) any electrical device or circuit that is electrically connected using the female battery or power cable.

Single bolt fuses, such as the prior art single bolt fuses described and illustrated above, feature M6, M8, and M10 sized threaded holes for connecting with M6, M8, and M10 insulated studs, respectively. However, the single bolt fuse assembly 400 may be designed with a threaded shaft of any size, sized to fit with a single bolt fuse having a hole of a similar size. The examples herein are not limited in regard to the size of the threaded shaft or the threaded hole.

Figure 7:
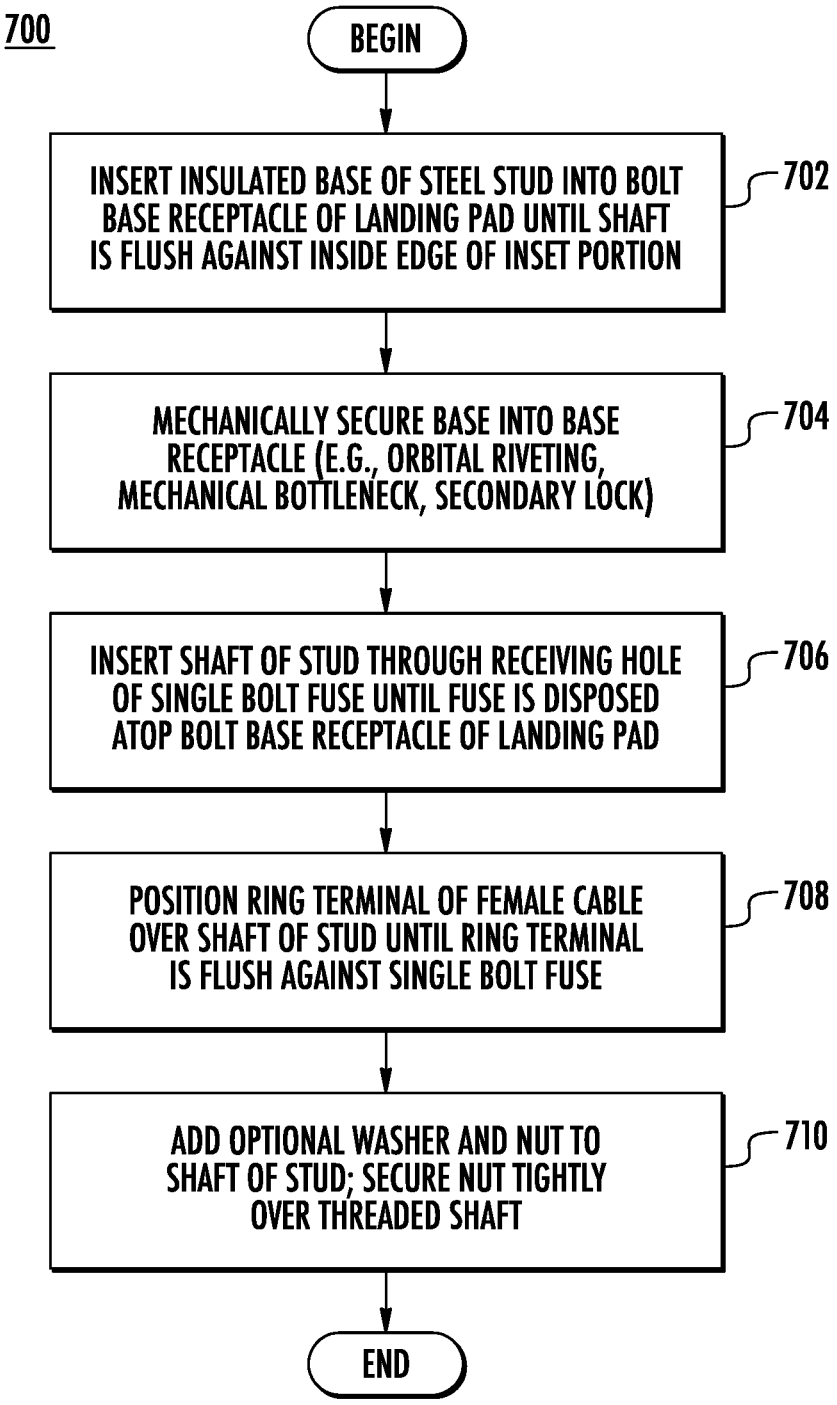
FIG. 7 is a flow diagram illustrating a method for connecting a single bolt fuse to a female battery or power cable, in accordance with exemplary embodiments.

FIG. 7 is a flow diagram illustrating a method 700 of assembling a single bolt fuse assembly with an electrically isolated bolt, such as the single bolt fuse assembly 400 described and illustrated above. For clarity, the reference numbers of the single bolt fuse assembly 400 are given in parentheses, though the method steps may apply to other configurations of single bolt fuse assemblies. The bottom rectangular-cube-like portion of the steel stud (408), known as the base (422), which is insulated, is inserted into the bolt base receptacle (404) of the metal terminal (402), known as the landing pad, which is sized to receive the insulated base (422). The shaft (410) of the steel stud (408), some of which is also insulated, fits flush against an inside edge of the inset portion (414) of a top surface of the bolt base receptacle (404) (block 702). Optionally, the base (422) can be secured inside the bolt base receptacle (404), such as by orbital riveting, mechanical bottleneck, secondary lock, or other means (block 704).

The shaft (410) is next inserted through the receiving aperture or shaft receptacle (428) of the single bolt fuse (426) until the fuse is disposed atop the bolt base receptacle (404) of the landing pad (402) (block 706). At this stage, the insulated portion (418) of the shaft (410) is partially inserted into the receptacle (428). The ring terminal (436) of the female battery or power cable (430) is positioned over the shaft (410) of the stud (408) until the ring terminal (436) is flush against the top surface of the single bolt fuse (426) (block 708). Finally, the washer (438)), if present, and nut (440 are disposed over the shaft (410) of the stud (408), and secured tightly thereon (block 710). Alternatively, the shaft (410) of the stud (408) is secured by a nut having an integrated washer, such as a flange nut, a trilobate nut, or other type of nut that can be used without a washer.

Figure 8A:
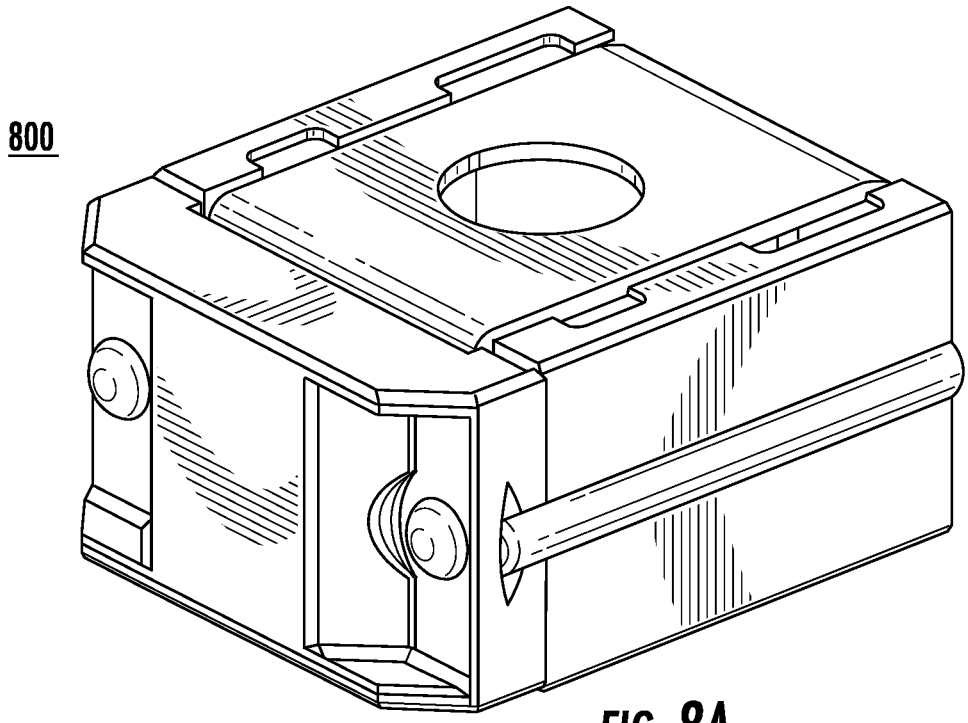
FIGS. 8A and 8B are diagrams of a single bolt fuse and a single bolt fuse assembly kit, respectively, in accordance with exemplary embodiments.
Figure 8B:
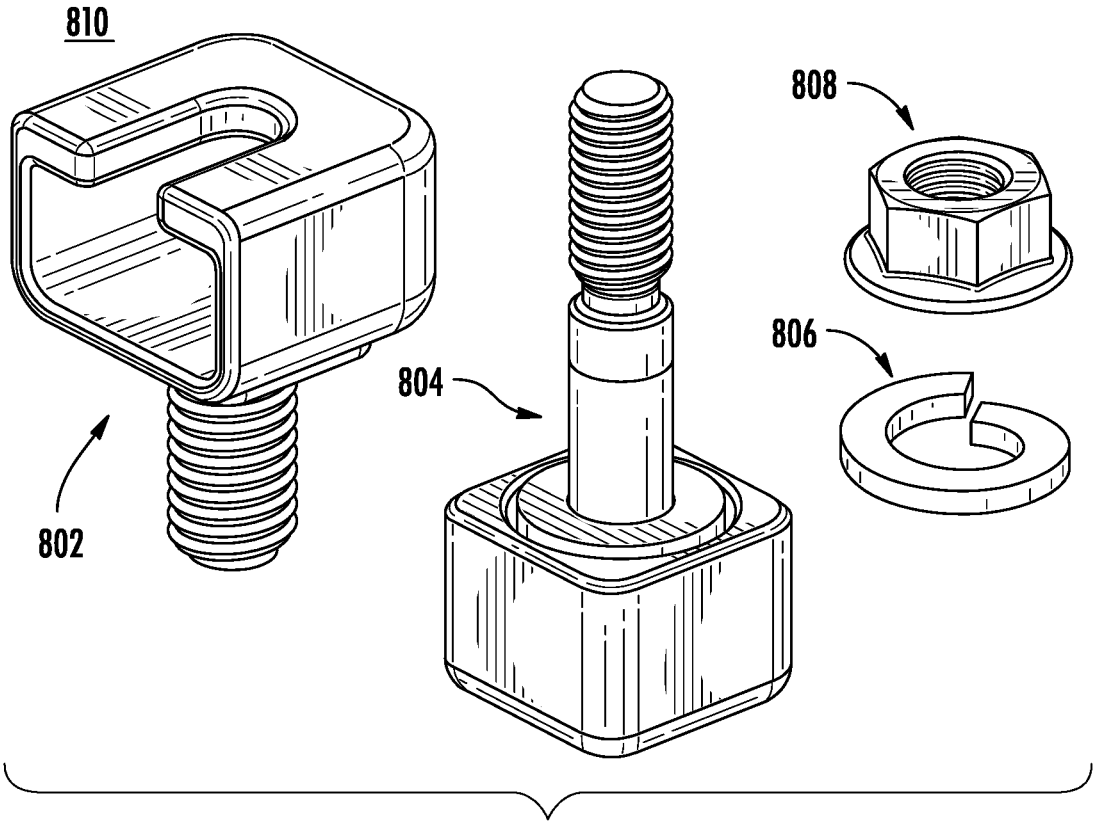

FIGS. 8A and 8B are illustrations of a single bolt fuse 800 and a single bolt fuse assembly kit 810, respectively, according to exemplary embodiments. Customers may want to assemble a single bolt fuse assembly, such as the single bolt fuse assembly 400 (FIGS. 4A-4C) or a configuration, such as the configuration 600 (FIG. 6) for connecting a single bolt fuse to an electrical device. Accordingly, the manufacturer may provide a variety of single bolt fuses for purchase, and, separately, may provide a variety of single bolt fuse assembly kits. Or the manufacturer may provide a kit including the fuse with the assembly. Thus, the single bolt fuse 800 (FIG. 8A) may be purchased as a standalone device, with the customer determining the specifications, such as current ratings, voltage ratings, and the like, to for their particular application. Separately, the customer may purchase a single bolt fuse assembly kit 810 (FIG. 8B) containing the metal terminal 802 (landing pad), steel bolt including insulated base 804, optional washer 806, and nut 808, which is properly sized for the single bolt fuse. In particular, this means that the shaft of the steel bolt 804 will fit through the hole of the single bolt fuse. The customer will likely already have the female battery or power cable (e.g., threaded battery or power cable 430 in FIGS. 4A and 4B), as this component may be part of the circuitry or device in their possession. Thus, in one embodiment, the female battery or power cable is not part of the assembly kit 810. Alternatively, the manufacture may sell the single bolt fuse 800 along with the assembly kit 810.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse assembly, comprising:

an insulated steel bolt comprising a base coupled to a shaft; and a metal terminal comprising a bolt base receptacle comprising a hollow interior with a side opening and an inset portion with a side opening, wherein the base is laterally presented into the side opening of the bolt base receptacle to fit the base into the hollow interior, and wherein the shaft of the insulated steel bolt is laterally presented into the side opening of the inset portion to fit the shaft of the insulated steel bolt into the inset portion;

wherein the base is a rectangular cube of a first dimension.

2. The fuse assembly of claim 1, wherein the shaft of the insulated steel bolt is to be fed through a cylindrical opening of a fuse.

3. The fuse assembly of claim 1, the metal terminal further comprising a shaft disposed on one side of the bolt base receptacle.

4. The fuse assembly of claim 1, wherein the hollow interior is a second rectangular cube of a second dimension.

5. The fuse assembly of claim 4, wherein the second dimension is greater than the first dimension.

6. The fuse assembly of claim 3, wherein the side opening of the hollow interior of the bolt base receptacle is on a surface of the bolt base receptacle adjacent the shaft of the metal terminal.

7. The fuse assembly of claim 1, the insulated steel bolt further comprising an insulated washer, wherein the insulated washer is disposed at a bottom portion of the shaft of the insulated steel bolt and is on top of the base.

8. The fuse assembly of claim 1, wherein the base is insulated with an electrically insulating overmolding material.

9. The fuse assembly of claim 3, wherein the bolt base receptacle and the shaft of the metal terminal are machined from a unitary, electrically conductive material.

10. The fuse assembly of claim 1, further comprising a nut and a washer, wherein the washer is secured on the shaft of the insulated steel bolt.

11. The fuse assembly of claim 10, wherein the shaft of the insulated steel bolt is of sufficient length to fit through a ring terminal of a female cable before the nut is secured on the shaft of the insulated steel bolt.

12. A fuse assembly, comprising:

an insulated steel bolt comprising a base coupled to a shaft; and a metal terminal comprising a bolt base receptacle comprising a hollow interior with a side opening, wherein the base is laterally presented into the side opening of the bolt base receptacle to fit the base into the hollow interior, and wherein the shaft of the insulated steel bolt is laterally presented into the side opening of the inset portion to fit the shaft of the insulated steel bolt into the inset portion;

wherein the base is insulated with an electrically insulating overmolding material.

13. The fuse assembly of claim 12, wherein the base is laterally presented into the side opening of the bolt base receptacle to fit the base into the hollow interior.

* * * * *